US011553807B2

(12) United States Patent
Rajagopalan et al.

(10) Patent No.: US 11,553,807 B2
(45) Date of Patent: Jan. 17, 2023

(54) MERCHANDISER WITH EVEN DISTRIBUTION FAN PLENUM

(71) Applicant: Hussmann Corporation, Bridgeton, MO (US)

(72) Inventors: Anand Ganesh Rajagopalan, Irvine, CA (US); Jiaching Liu, Monterrey Park, CA (US); Sandeep Palaksha, Belgaluru (IN)

(73) Assignee: Hussmann Corporation, Bridgeton, MO (US)

( * ) Notice: Subject to any disclaimer, the term of this patent is extended or adjusted under 35 U.S.C. 154(b) by 55 days.

(21) Appl. No.: 17/041,819

(22) PCT Filed: Mar. 26, 2018

(86) PCT No.: PCT/US2018/024329
§ 371 (c)(1),
(2) Date: Sep. 25, 2020

(87) PCT Pub. No.: WO2019/190457
PCT Pub. Date: Oct. 3, 2019

(65) Prior Publication Data

US 2021/0085099 A1 Mar. 25, 2021

(51) Int. Cl.
*A47F 3/04* (2006.01)
*F25D 17/06* (2006.01)

(52) U.S. Cl.
CPC ..... *A47F 3/0447* (2013.01); *A47F 3/0456* (2013.01); *F25B 2400/22* (2013.01); *F25D 17/067* (2013.01)

(58) Field of Classification Search
CPC .... A47F 3/0447; A47F 3/0456; A47F 3/0443; F25B 2400/22; F25B 17/067; F25B 2500/02
See application file for complete search history.

(56) References Cited

U.S. PATENT DOCUMENTS 2,632,310 A 3/1953 Kopp et al.
2,711,083 A 6/1955 Schultz
(Continued)

FOREIGN PATENT DOCUMENTS

CN 105737634 A 7/2016
EP 2708161 A1 3/2014

OTHER PUBLICATIONS

International Search Report and Written Opinion for Application No. PCT/US2018/024329 dated Jan. 2, 2019 (10 pages).

*Primary Examiner* — Emmanuel E Duke
(74) *Attorney, Agent, or Firm* — Michael Best & Friedrich LLP

(57) ABSTRACT

A heat exchanger for a refrigerated merchandiser includes a fan housing having an asymmetrical configuration. The fan housing can include a first section with a first open outlet and a second section with a second open outlet. A first fan is positioned in the first section and configured to create a first airflow through the first open outlet. A second fan is positioned in the second section and configured to create a second airflow through the second open outlet. An evaporator is in fluid communication with the first open outlet and second open outlet. The first section is asymmetrical about a first section central axis and the second section is asymmetrical about a second section central axis.

20 Claims, 4 Drawing Sheets

(56) References Cited

U.S. PATENT DOCUMENTS

| | | | | | |
|---|---|---|---|---|---|
| 3,675,440 | A | | 7/1972 | Ibrahim | |
| 4,439,992 | A | | 4/1984 | Ibrahim | |
| 4,971,143 | A | * | 11/1990 | Hogan | F04D 29/544 165/122 |
| 5,475,988 | A | * | 12/1995 | McGovern | F25D 21/14 62/256 |
| 5,517,826 | A | * | 5/1996 | Duffy | A47F 3/0443 62/297 |
| 5,531,267 | A | | 7/1996 | Ahmed et al. | |
| 5,870,903 | A | | 2/1999 | Meyers et al. | |
| 5,951,247 | A | * | 9/1999 | Rockwell | F04D 29/541 415/208.4 |
| 6,145,327 | A | | 11/2000 | Navarro | |
| 6,519,962 | B1 | | 2/2003 | Schuetter | |
| 6,578,376 | B2 | | 6/2003 | Thurman | |
| 6,742,344 | B2 | | 6/2004 | Vormedal | |
| 6,755,042 | B2 | * | 6/2004 | Chuang | A47F 3/0447 454/193 |
| 6,955,061 | B2 | | 10/2005 | Chiang et al. | |
| 7,062,931 | B2 | | 6/2006 | Wilson | |
| 9,220,351 | B2 | | 12/2015 | Nguyen et al. | |
| 9,456,707 | B2 | | 10/2016 | Moody et al. | |
| 2009/0215380 | A1 | | 8/2009 | Lin | |
| 2010/0230076 | A1 | | 9/2010 | Yang et al. | |
| 2013/0213074 | A1 | * | 8/2013 | Nguyen | A47F 3/04 62/255 |
| 2013/0319030 | A1 | * | 12/2013 | Nguyen | A47F 3/0447 62/256 |
| 2016/0058207 | A1 | * | 3/2016 | Choueifati | F25D 15/00 62/251 |
| 2016/0116204 | A1 | | 4/2016 | Li et al. | |
| 2017/0150829 | A1 | * | 6/2017 | Bates | F25D 23/023 |
| 2017/0354271 | A1 | * | 12/2017 | Neelagantan | A47F 3/0439 |

* cited by examiner

MERCHANDISER WITH EVEN DISTRIBUTION FAN PLENUM

BACKGROUND

The application relates to a merchandiser including a fan apparatus that creates an even air flow distribution.

Generally, refrigerated display case merchandisers use forced air convention systems designed with a heat exchanger assembly that includes one or more evaporator coils and one or more fans positioned in a plenum. The fans force a certain volume of air over the coil to achieve desired cooling through natural convection. Cooled air is directed through one or more air passageways in the merchandiser to provide cooling to a product display area.

SUMMARY

In one embodiment, a heat exchanger for a refrigerated merchandiser includes a fan housing having a first section with a first open outlet and a second section with a second open outlet. A first fan is positioned in the first section and configured to create a first airflow through the first open outlet. A second fan is positioned in the second section and configured to create a second airflow through the second open outlet. An evaporator is in fluid communication with the first open outlet and second open outlet. The first section is asymmetrical about a first section central axis and the second section is asymmetrical about a second section central axis.

In another embodiment, a heat exchanger for a refrigerated merchandiser includes a fan housing having an open outlet. A first fan is positioned in the fan housing and configured to create a first airflow through the open outlet. A second fan is positioned in the fan housing and configured to create a second airflow through the open outlet. An evaporator is in fluid communication with the open outlet. The fan housing is asymmetrical about a housing central axis.

In another embodiment, a heat exchanger for a refrigerated merchandiser includes a fan housing first section and a fan housing second section. The fan housing first section has a first rear wall, a first side wall, a second side wall, and a first open outlet. The fan housing second section has a second rear wall, a third side wall, a fourth side wall, and a second open outlet. A first fan is positioned in the first section and configured to create a first airflow through the first open outlet. A second fan is positioned in the second section and configured to create a second airflow through the second open outlet. An evaporator is in fluid communication with the first open outlet and second open outlet. The first side wall intersects the first rear wall at a first angle. The second side wall intersects the first rear wall at a second angle that is different than the first angle A1. The first side wall intersects the first open outlet at a third angle complimentary to the first angle. The second side wall intersects the first open outlet at a fourth angle complimentary to the second angle.

In another embodiment, a refrigerated merchandiser includes a case defining a product display area and includes a base and an air passageway to direct air to the product display area. A heat exchanger is configured to cool the air directed to the product display area. The heat exchanger includes a fan housing having a first section with a first open outlet and a second section with a second open outlet. A first fan is positioned in the first section and configured to create a first airflow through the first open outlet. A second fan is positioned in the second section and configured to create a second airflow through the second open outlet. An evaporator is in fluid communication with the first open outlet and second open outlet. The first section is asymmetrical about a first section central axis and the second section is asymmetrical about a second section central axis.

In another embodiment, a refrigerated merchandiser includes a case defining a product display area and includes a base and an air passageway to direct air to the product display area. A heat exchanger is configured to cool the air directed to the product display area. The heat exchanger includes a fan housing having an open outlet. A first fan is positioned in the fan housing and configured to create a first airflow through the open outlet. A second fan is positioned in the fan housing and configured to create a second airflow through the open outlet. An evaporator is in fluid communication with the open outlet. The fan housing is asymmetrical about a housing central axis.

In another embodiment, a refrigerated merchandiser includes a case defining a product display area and includes a base and an air passageway to direct air to the product display area. A heat exchanger is configured to cool the air directed to the product display area. The heat exchanger includes fan housing first section and a fan housing second section. The fan housing first section has a first rear wall, a first side wall, a second side wall, and a first open outlet. The fan housing second section has a second rear wall, a third side wall, a fourth side wall, and a second open outlet. A first fan is positioned in the first section and configured to create a first airflow through the first open outlet. A second fan is positioned in the second section and configured to create a second airflow through the second open outlet. An evaporator is in fluid communication with the first open outlet and second open outlet. The first side wall intersects the first rear wall at a first angle. The second side wall intersects the first rear wall at a second angle that is different than the first angle. The first side wall intersects the first open outlet at a third angle complimentary to the first angle. The second side wall intersects the first open outlet at a fourth angle complimentary to the second angle.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. As used herein and in the appended claims, the terms "upper", "lower", "top", "bottom", "front", "back", and other directional terms are not intended to require any particular orientation, but are instead used for purposes of description only.

Figure 1:
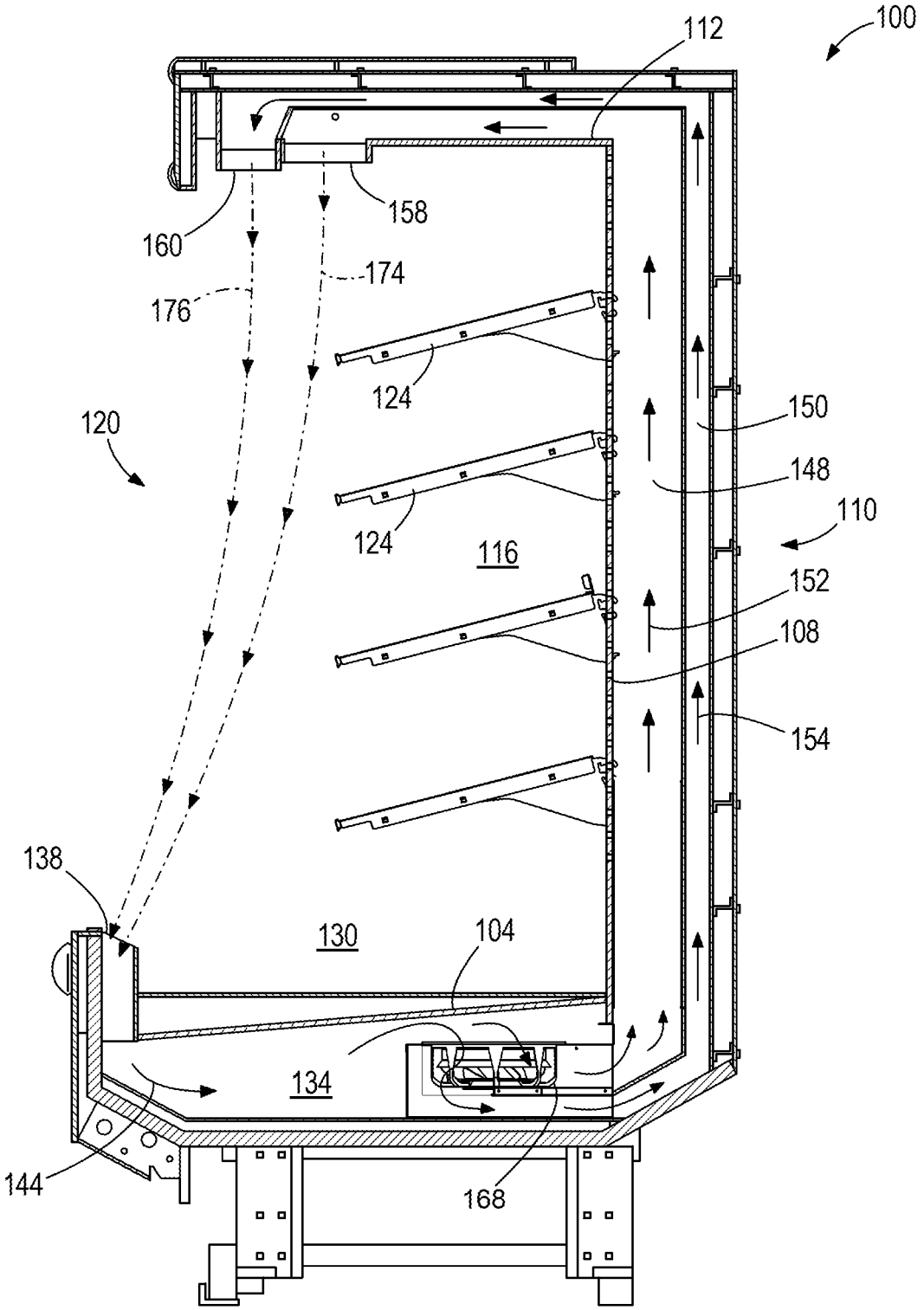
FIG. 1 is a section view of a merchandiser including a product display area, a first air passageway, a second air passageway, and a fan apparatus.

FIG. 1 shows a refrigerated merchandiser 100 that supports product for access by consumers. The merchandiser 100 includes a case 110 that has a base 104, a rear wall 108, and a canopy or case top 112. The area partially enclosed by the base 104, the rear wall 108, and the canopy 112 defines a product display area 116. As illustrated, the product display area 116 is accessible by customers through an opening 120 adjacent the front of the case 110. Shelves 124 are coupled to the rear wall 108 and extend forward toward the opening 120 adjacent the front of the merchandiser 100 to support food product that is accessible by a consumer through the opening 120. Although the merchandiser 100 illustrated and described with regard to FIG. 1 is an open-front, vertically-oriented merchandiser, the merchandiser 100 can be any type of merchandiser that supports product (e.g., a horizontal merchandiser, an enclosed merchandiser with doors, etc.). All such merchandisers are considered herein.

The base 104 defines a lower portion 130 of the product display area 116 and can support a portion of the food product in the case 110. The base 104 further defines a lower flue 134 and includes an inlet 138 located adjacent the opening 120. As illustrated, the lower flue 134 is in fluid communication with the inlet 138 and conducts airflow 144 substantially horizontally through the base 104 from the inlet 138. The inlet 138 is positioned to receive surrounding air in a substantially vertical direction to direct it into the lower flue 134. The case 110 includes a primary rear flue 148 and a secondary rear flue 150 extending upward from the base 104 and in fluid communication with the lower flue 134. The primary rear flue 148 directs a first airflow 152 through the case 110 to a primary outlet 158. The secondary rear flue 150 directs a secondary airflow 154 through the case 110 to a secondary outlet 160. In some constructions, the rear wall 108 can include apertures (not shown) that fluidly couple the primary rear flue 148 with the product display area 116 to permit at least some of the primary airflow 152 to enter the product display area 116.

The lower flue 134 and the primary rear flue 148 are fluidly coupled to each other to define a primary air passageway that directs a portion of the airflow 144 (i.e., the primary airflow 152) from the inlet 138 to the primary outlet 158. The lower flue 134 and the secondary rear flue 150 are fluidly coupled to each other to define a secondary air passageway that directs the remaining portion of the airflow 144 (i.e., the secondary airflow 154) from the inlet 138 to the secondary outlet 160.

FIG. 1 shows that the merchandiser 100 also includes a fan assembly 168 that is positioned in the base 104 and in fluid communication with the lower flue 134. As will be understood by one of ordinary skill in the art, the fan assembly 168 can be associated with a heat exchanger (not shown) that transfers heat from the primary airflow 152 to refrigerant flowing through the heat exchanger.

Figure 2:
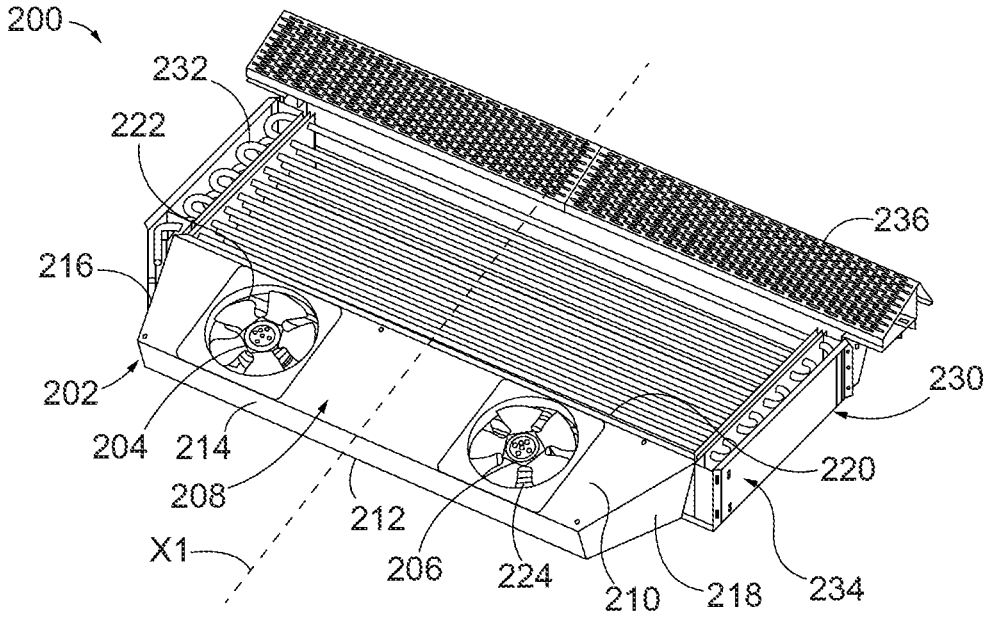
FIG. 2 is a perspective view of a first heat exchanger for use with a merchandiser.
Figure 3:
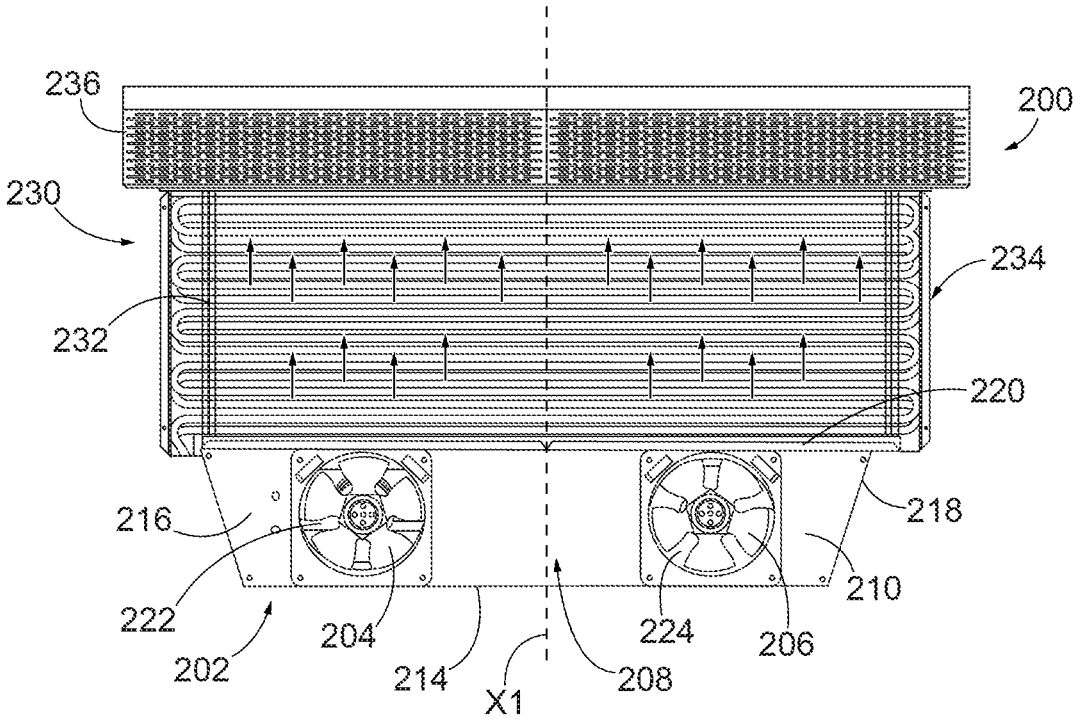
FIG. 3 is a top view of the heat exchanger of FIG. 2.

FIGS. 2 and 3 show an exemplary embodiment of a heat exchanger 200 that can be used with a refrigerated merchandiser. The heat exchanger 200 can be positioned in the base of the merchandiser similar to what is shown in FIG. 1. The heat exchanger 200 includes a fan assembly 202 having a first fan 204 and a second fan 206 positioned in a dual fan housing 208. The plenum housing 208 includes a top wall 210, a bottom wall 212, a rear wall 214, a first side wall 216 and a second side wall 218 connected to define a plenum interior and an outlet 220. The top wall 210 includes a first opening 222 into which the first fan 204 is secured, and a second opening 224 into which the second fan 206 is secured. The fans 204, 206 are connected to motors (not shown in detail) that power rotation of the fans 204, 206 to draw air into the housing 208 and to push air through the outlet 220. When viewed from the side, the housing 208 has a substantially trapezoidal configuration due to the top wall 210 being oriented at a non-zero angle relative to the bottom wall 212. The housing 208 is also symmetrical about a central axis X1 extending in the direction of the airflow exiting the housing 208.

The outlet 220 of the fan housing 208 is in communication with an evaporator assembly 230. The evaporator assembly 230 includes one or more evaporator coils 232 positioned in an evaporator support 234. The support 234 is shown in FIGS. 2 and 3 without a top wall for clarity. The illustrated evaporator assembly 230 has four rows of evaporator coils 232, although fewer or more rows of coils 232 can be used. Refrigerant is circulated through the evaporator coils 232 as part of a refrigeration circuit (not shown). Air exiting the outlet 220 of the fan housing 208 flows through the evaporator assembly 230 and is cooled through heat exchange with refrigerant flowing through the evaporator coils 232. The cooled air exits the evaporator assembly 230 through a discharge plenum or grill 236. The grill 236 includes a plurality of apertures that direct the airflow into the airflow passageway.

During operation, the fans 204, 206 rotate in a single direction, for example counter-clockwise in the view shown in FIG. 3. This rotation can cause a bias in the velocity of the airflow through the fan housing 208, with the velocity of the airflow toward the first side wall 216 of the fan housing 208 being greater than the velocity of the airflow toward the second side wall 218. The airflow bias causes a thermal bias resulting in one side getting more effective cooling during refrigeration cycle and also more effective clearing of the evaporator coil during defrost cycles.

Figure 4:
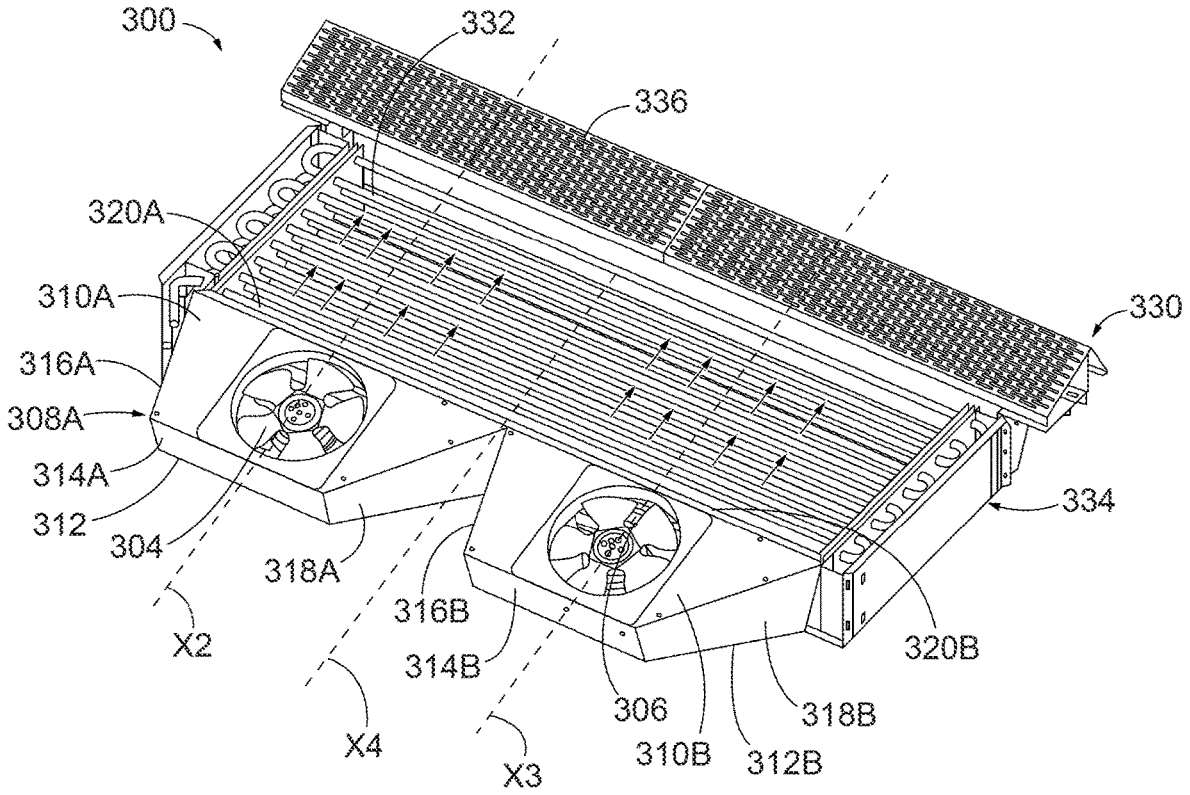
FIG. 4 is a perspective view of another heat exchanger for use with the merchandiser.
Figure 5:
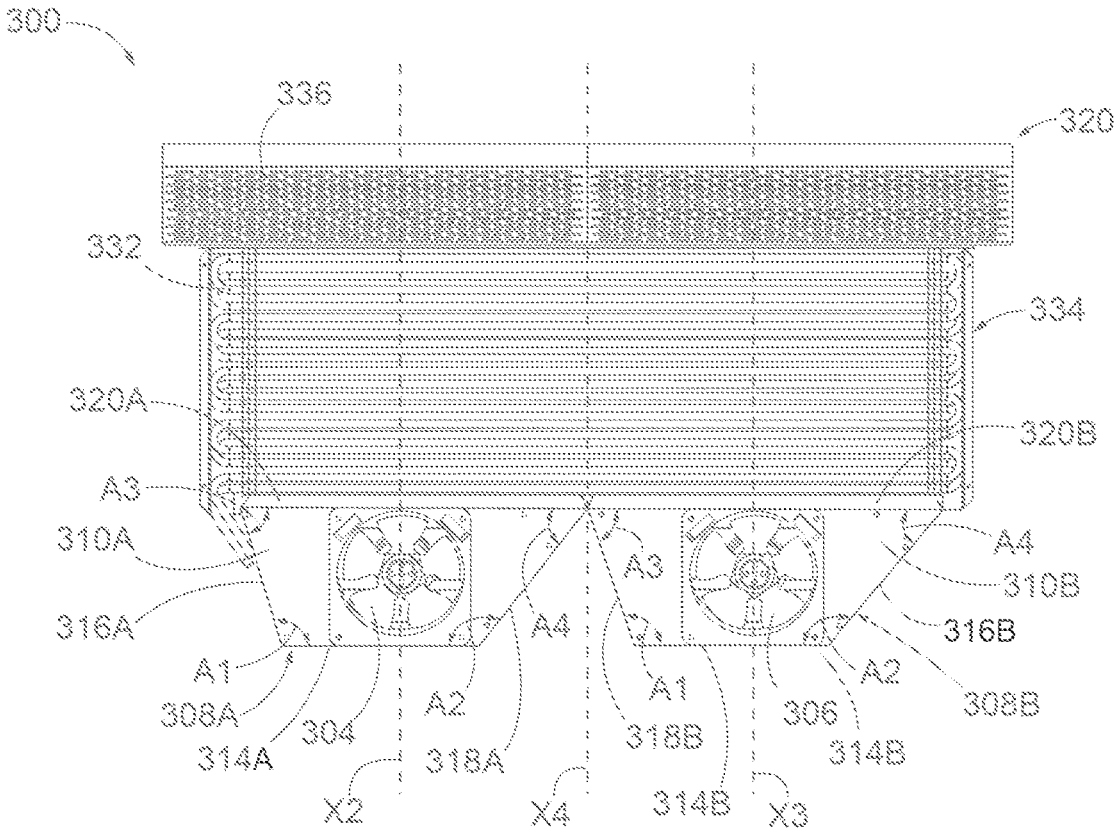
FIG. 5 is a top view of the heat exchanger of FIG. 4.
Figure 6:
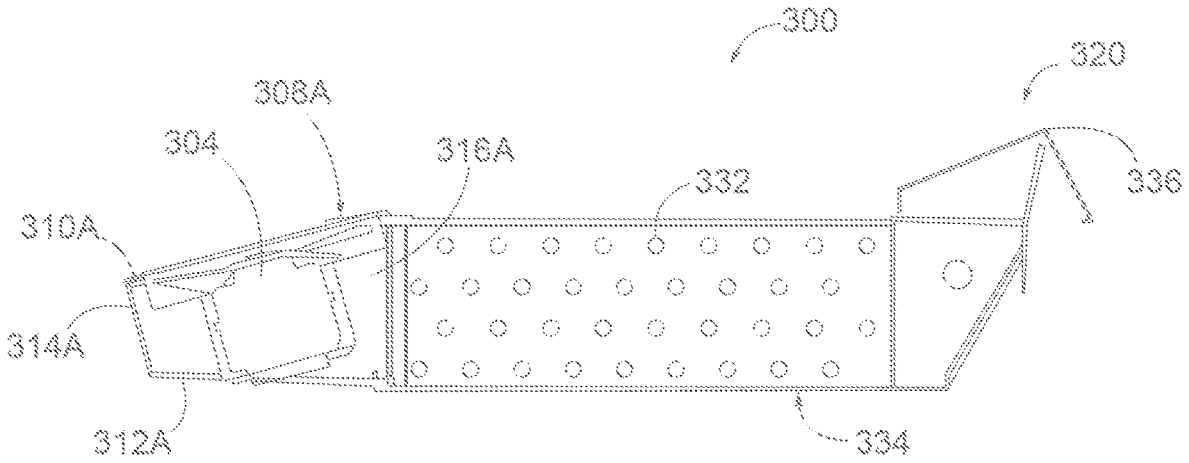
FIG. 6 is a side, sectional view of the heat exchanger of FIG. 4 taken through axis X2.

FIGS. 4-6 show an exemplary embodiment of another heat exchanger 300 that can be used with the refrigerated merchandiser. The heat exchanger includes a fan assembly 302 having a first fan 304 and a second fan 306 positioned in a fan housing divided into a first section 308A and a second section 308B. Each of the first and second sections include a top wall 310A, 310B, a bottom wall 312A, 312B, a rear wall 314A, 314B, a first side wall 316A, 316B, and a second side wall 318A, 318B connected to define a housing interior and an outlet 320A, 320B. Each housing section 308A, 308B has a substantially trapezoidal configuration so that the outlet 320A, 320B is wider than the rear wall 314A, 314B. The first and second housing sections 308A, 308B are divided so that there is no fluid communication between the two. The first housing section 308A abuts the second housing section 308B near the outlets 320A, 320B. In certain embodiments, the first and second housing sections 308A, 308B can include a common outlet that allows some fluid communication or mixing between the airflow from the first housing section 308A and the second housing section 308B. In other embodiments, the fan housing can be continuous, having a single rear wall, and two side walls, and the first and second housing sections 308A, 308B can be created by one or more dividers of baffles positioned inside the interior of the housing.

The first housing section 308A is asymmetrical about a first section central axis X2 extending through the housing section 308A in the direction of the airflow exiting the outlet 320A. The second housing section 308B is asymmetrical about a second section central axis X3 extending through the housing section 308B in the direction of the airflow exiting the outlet 320B. The first and second section central axes X2, X3 are shown extend approximately through the center of the respective fans 304, 306, although the housing sections 308A, 308B will be asymmetric about any point. The combined fan housing is also asymmetrical about a housing central axis X4 extending in the direction of the airflow exiting the outlets 320A, 320B. Although depicted as asymmetrical about these specific central axes, the housing sections 308A, 308B and the combined housing may also be configured as asymmetrical about central axes in other planes.

FIGS. 4-6 shows an exemplary embodiment where the asymmetrical configuration of the housing sections 308A, 308B are achieved by the first side wall 316A, 316B intersecting the rear wall 314A, 314B at a first angle A1 and the second side wall 318A, 318B intersecting the rear wall 314A, 314B at a second angle A2 that is different than the first angle A1. The first side wall 316A, 316B meets the outlet 320A, 320B at a third angle A3, which is complimentary to the first angle A1, and the second side wall 318A, 318B meets the outlet 320A, 320B at a fourth angle A4, which is complementary to the second angle A2. The rear wall 314A, 314B and the outlet 320A, 320B are substantially perpendicular so that the length of the first side wall 316A, 316B does not equal the length of the second side wall 318A, 318B. A fifth angle A5 is formed between the second side wall 318A of the first housing section 308A and the first side wall 316B of the second housing section 308B. In the illustrated embodiment, the first angle A1 is approximately 107 degrees, the second angle A2 is approximately 130 degrees, the third angle A3 is approximately 73 degrees, the fourth angle A4 is approximately 50 degrees, and the fifth angle A5 is approximately 57 degrees. These angles can be adjusted to accommodate for different sized housings and for different airflow profiles while still retaining asymmetry.

The outlets 320A, 320B of the fan housing sections 308A, 308B are in communication with an evaporator assembly 330. The evaporator assembly 330 includes one or more evaporator coils 332 positioned in an evaporator support 334. The support 334 is shown in FIGS. 4-6 without a top wall for clarity. The illustrated evaporator assembly 330 has four rows of evaporator coils 332, although fewer or more rows of coils 332 can be used. Refrigerant is circulated through the evaporator coils 332 as part of a refrigeration circuit (not shown). Air exiting the outlet 320 of the fan housing 308 flows through the evaporator assembly 330 and is cooled through heat exchange with refrigerant flowing through the evaporator coils 332. The cooled air exits the evaporator assembly 330 through a discharge plenum or grill 336. The grill 336 includes a plurality of apertures that direct the airflow into the airflow passageway.

Even when the first and second fans 304, 306 rotate in the same direction, the asymmetric nature of the housing 308 and/or the housing sections 308A, 308B creates a more even airflow velocity through the outlets 320A, 320B of the housing 308. This reduces or eliminates the thermal bias, and results in more even cooling during refrigeration cycle and also more even clearing of the evaporator coil during defrost cycles.

Various features and advantages of the invention are set forth in the following claims.

The invention claimed is:

1. A heat exchanger for a refrigerated merchandiser comprising:

a fan housing including a first section with a first open outlet and a second section with a second open outlet, each of the first section and the second section having a first side wall and a second side wall;

a first fan positioned in the first section and configured to create a first airflow through the first open outlet;

a second fan positioned in the second section and configured to create a second airflow through the second open outlet; and an evaporator in fluid communication with the first open outlet and second open outlet, wherein a first section central axis extends through a center of the first section and a second section central axis extends through a center the second section, and wherein the first side wall and the second side wall of the first section are oriented at different angles relative to the first section central axis such that the first section is asymmetrical about the first section central axis, and the first side wall and the second side wall of the second section are oriented at different angles relative to the second section central axis such that the second section is asymmetrical about the second section central axis.

2. The heat exchanger of claim 1, wherein the first section central axis extends through the first housing section in the direction of the first airflow and the second section central axis extends through the second housing section in the direction of the second airflow.

3. The heat exchanger of claim 1, wherein the fan housing is asymmetrical about a housing central axis.

4. The heat exchanger of claim 1, wherein the first housing section abuts the second housing section.

5. The heat exchanger of claim 1, wherein there is no fluid communication between the first housing section and the second housing section.

6. The heat exchanger of claim 1, wherein the first housing section and the section housing section have a trapezoidal configuration.

7. The heat exchanger of claim 1, wherein each of the first and second housing sections further includes a rear wall.

8. The heat exchanger of claim 1, wherein the fan housing includes a first housing section and a second housing section.

9. The heat exchanger of claim 8, wherein the first section is asymmetrical about a first section central axis and the second section is asymmetrical about a second section central axis.

10. The heat exchanger of claim 9, wherein each of the first and second housing sections includes a rear wall and the first housing section abuts the second housing section.

11. The heat exchanger of claim 9, wherein there is no fluid communication between the first housing section and the second housing section.

12. A heat exchanger for a refrigerated merchandiser comprising:

a fan housing including a first side wall, a second side wall, and an outlet;

a first fan positioned in the fan housing and configured to create a first airflow through the outlet;

a second fan positioned in the fan housing and configured to create a second airflow through the outlet; and an evaporator in fluid communication with the outlet, wherein a housing central axis extends through a center of the fan housing, and wherein the first side wall and the second side wall are oriented at different angles relative to the housing central axis such that the fan housing is asymmetrical about the housing central axis.

13. The heat exchanger of claim 12, wherein the housing central axis extends through the fan housing in the direction of the first and second airflows.

14. A heat exchanger for a refrigerated merchandiser comprising:

a fan housing first section having a first rear wall, a first side wall, a second side wall, and a first open outlet;

a fan housing second section having a second rear wall, a third side wall, a fourth side wall, and a second open outlet;

a first fan positioned in the first section and configured to create a first airflow through the first open outlet;

a second fan positioned in the second section and configured to create a second airflow through the second open outlet; and an evaporator in fluid communication with the first open outlet and second open outlet, wherein the first side wall intersects the first rear wall at a first angle, the second side wall intersects the first rear wall at a second angle that is different than the first angle, the first side wall intersects the first open outlet at a third angle complementary to the first angle, and the second side wall intersects the first open outlet at a fourth angle complementary to the second angle.

15. The heat exchanger of claim 14, wherein the first rear wall is perpendicular to the first outlet opening.

16. The heat exchanger of claim 14, wherein a length of first side wall is not equal to a length of the second side wall.

17. The heat exchanger of claim 14, wherein the first housing section abuts the second housing section.

18. The heat exchanger of claim 14, wherein there is no fluid communication between the first housing section and the section housing section.

19. The heat exchanger of claim 14, wherein the first angle is approximately 107 degrees, the second angle is approximately 130 degrees, the third angle is approximately 73 degrees, and the fourth angle is approximately 50 degrees.

20. The heat exchanger of claim 19, wherein the second side wall intersects the third side wall at a fifth angle, and wherein the firth angle is approximately 57 degrees.

* * * * *